US006405865B1

(12) United States Patent
Lin

(10) Patent No.: US 6,405,865 B1
(45) Date of Patent: Jun. 18, 2002

(54) TOOL BOX WITH BITS RECEIVED THEREIN

(75) Inventor: Ming-Nee Lin, Taichung Hsien (TW)

(73) Assignee: Home Soon Enterprise Co., Ltd., Taichung Hsien (TW)

( * ) Notice: Subject to any disclaimer, the term of this patent is extended or adjusted under 35 U.S.C. 154(b) by 68 days.

(21) Appl. No.: 09/634,860

(22) Filed: Aug. 8, 2000

(51) Int. Cl.[7] ..... B65D 85/28

(52) U.S. Cl. ..... 206/379; 206/216; 206/373; 206/374; 206/375; 206/376; 206/377

(58) Field of Search ..... 206/373, 374, 206/375, 379, 376, 377, 216; 211/69; 451/358

(56) References Cited

U.S. PATENT DOCUMENTS 273,621 A * 3/1883 Small ..... 7/144
2,530,024 A * 11/1950 Moody ..... 206/375
4,241,773 A * 12/1980 Personnat ..... 81/177.4
5,512,165 A * 4/1996 Liu ..... 206/234
5,535,882 A * 7/1996 Liu ..... 206/337
5,595,294 A * 1/1997 McKenzie et al. ..... 206/349
5,669,492 A * 9/1997 Chao ..... 206/234
5,839,579 A * 11/1998 Lee ..... 206/378
5,951,385 A * 9/1999 Newhouse et al. ..... 451/358

* cited by examiner

*Primary Examiner*—Paul T. Sewell
*Assistant Examiner*—Troy Arnold
(74) *Attorney, Agent, or Firm*—Rosenberg, Klein & Lee

(57) ABSTRACT

A tool box includes a body and a cap movably mounted to the body which has an board and a post extends from the board. A plurality of passages are defined through the post so as to receive bits in the passages. An engaging recess is defined in a distal end of the post. The cap has an open bottom for mounting to the post and a close top through which a hole is defined so that a bit extends through the hole and is securely engaged with the engaging recess, and the tool box is used as a screwdriver.

7 Claims, 7 Drawing Sheets

TOOL BOX WITH BITS RECEIVED THEREIN

FIELD OF THE INVENTION

The present invention relates to a tool box comprising a body with bits received therein and a cap mounted to the body. The body has an engaging recess for receiving a bit so that the tool box can be used as a screwdriver or the like.

BACKGROUND OF THE INVENTION

A conventional tool box generally includes a large box comprising a base and a cover which is pivotally connected to the base. The base and the cover each have a plurality of recesses defined therein so that many types of bits and tools are received in the tool box. However, such a huge tool box is inconvenient to be carried with the users because it is too heavy and occupies a large space. Some screwdrivers receive bits in a handle thereof and the user picks one bit from the handle and engages the bit on a shank of the screwdriver. Nevertheless, the bits make the total weight of the screwdriver too heavy which is inconvenient to be used. Besides, in order to receive the bits in the handle, the length of the handle has to be prolonged.

The present invention intends to provide a tool box that receives bits in a body thereof and a cap is movably mounted to the body. A bit can be engaged to a top of the body and a positioning means in the body secures the cap while using the tool box as a bit tool.

SUMMARY OF THE INVENTION

In accordance with one aspect of the present invention, there is provided a tool box and comprising a body having an board and a post extending from the board. A plurality of passages are defined through the post so that bits are received in the passages. An engaging recess is defined in a distal end of the post for engaging with a bit. A cap is movably mounted to the body and a hole is defined through a close top of the cap so that the bit extends through the hole and is engaged with the engaging recess.

The primary object of the present invention is to provide a tool box wherein bit are received in the tool box and a bit is engaged with the tool box to be used as a screwdriver.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
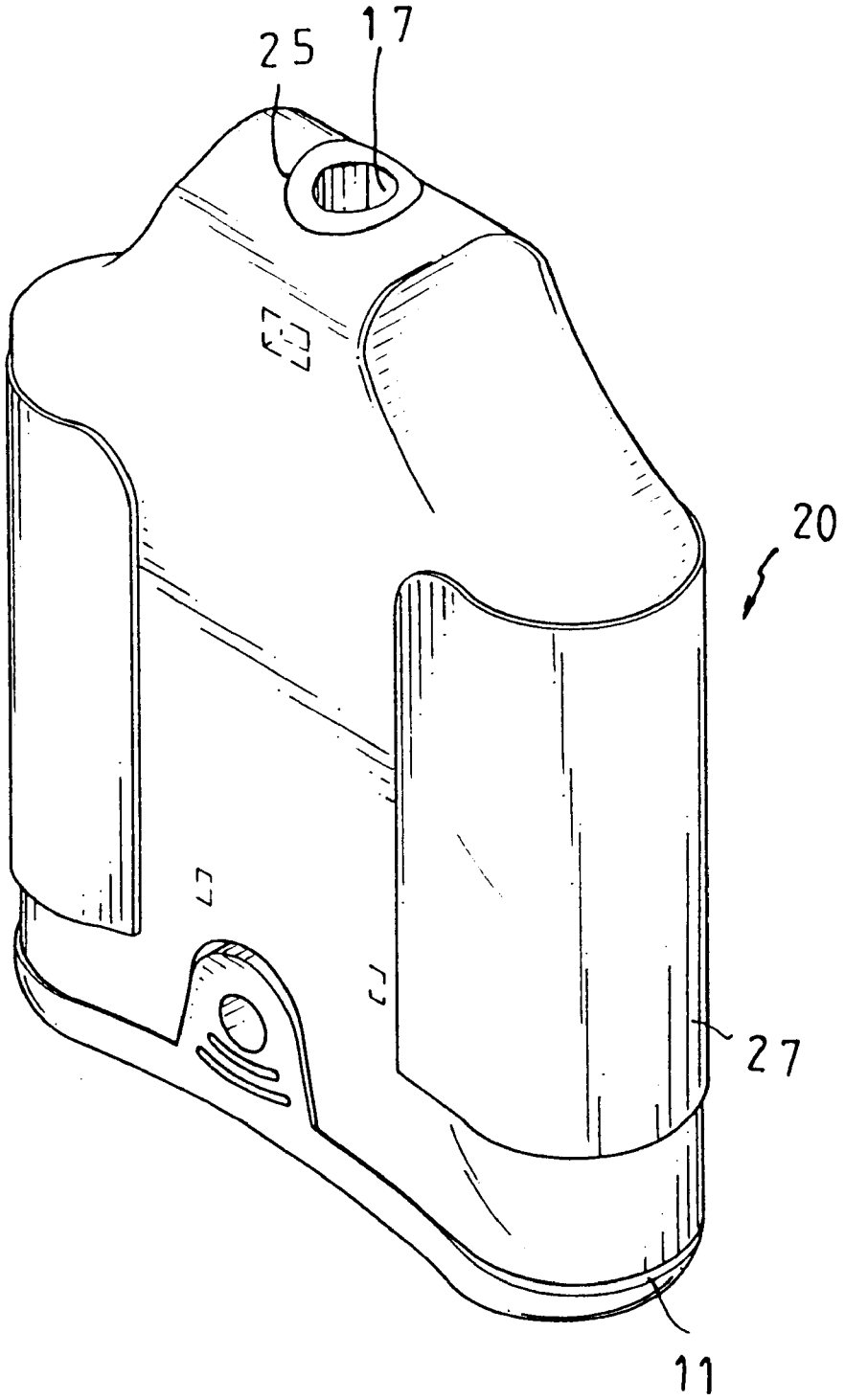
FIG. 1 is a perspective view to show a tool box of the present invention.
Figure 2:
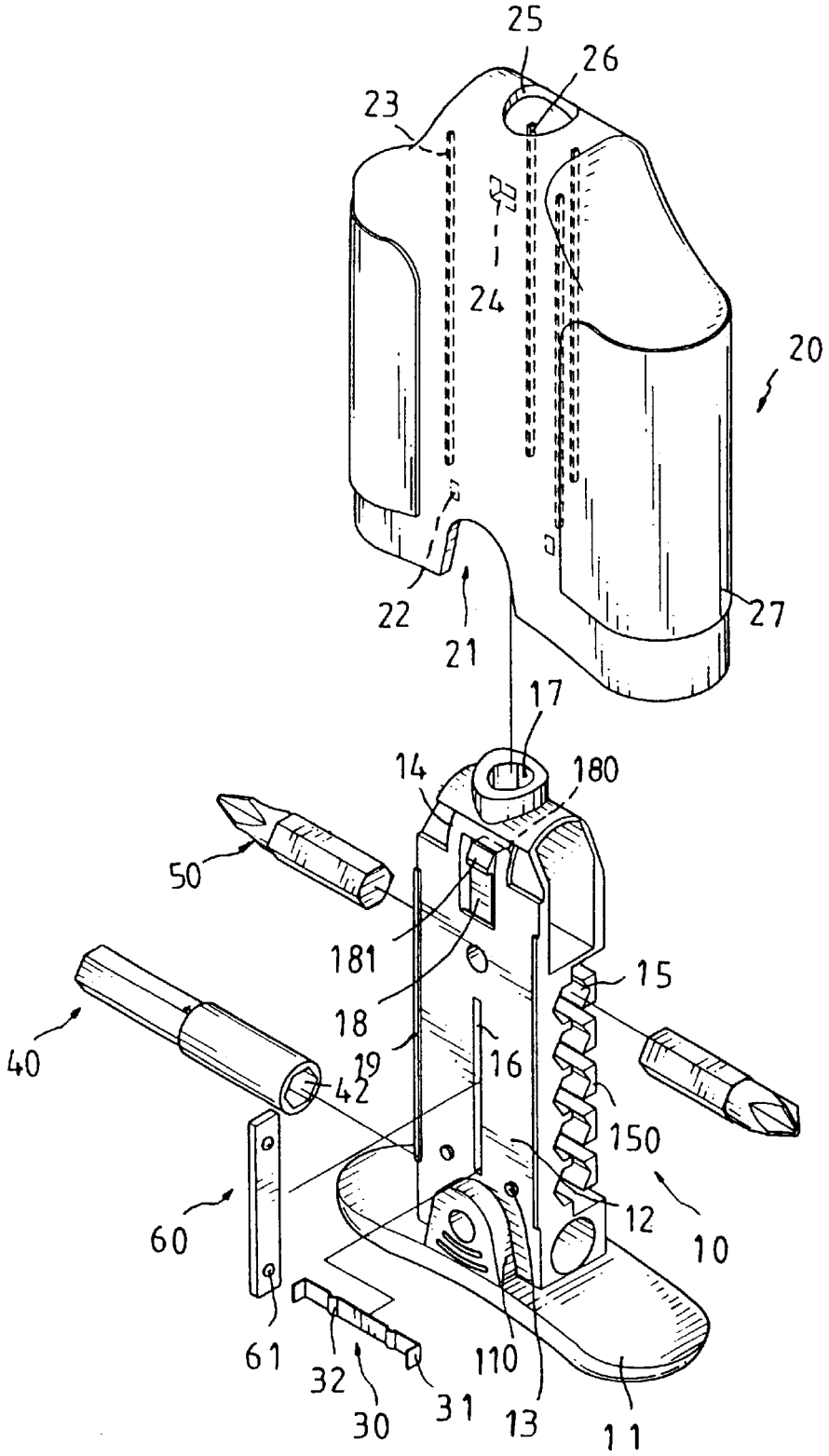
FIG. 2 is an exploded view to show the tool box of the present invention.
Figure 3:
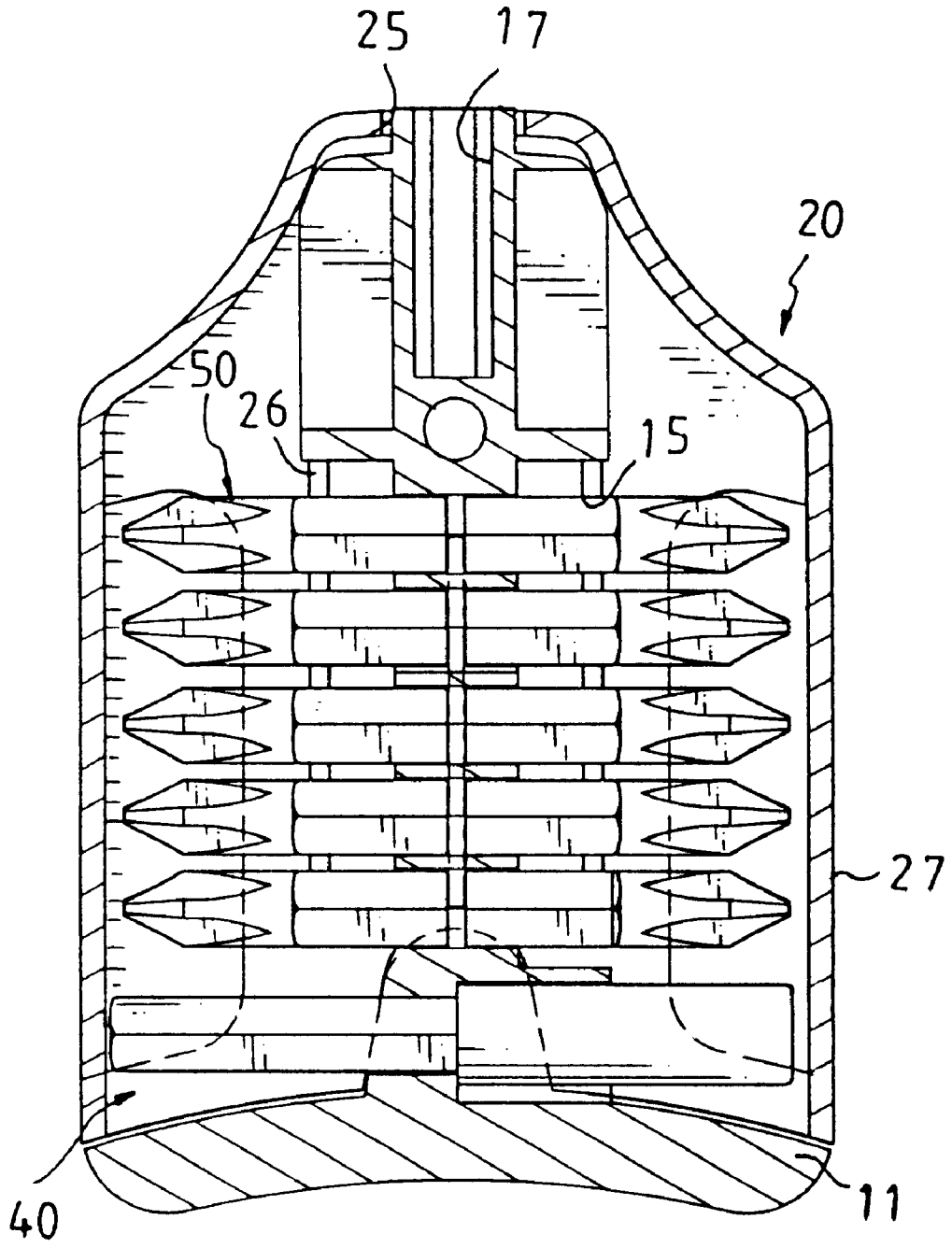
FIG. 3 is a cross sectional view to show that bits are received in the passages in a post of the tool box.

Referring to FIGS. 1 to 3, the tool box of the present invention comprises a body 10 and a cap 20 wherein the body 10 has an board 11 and a post 12 extends from the board 11. A plurality of passages 15 are defined transversely through the post 12 so as to receive bits 50 therein. Each passage 15 includes a flexible guide plate 150 so as to clamp the bit 50 in position. An engaging recess 17 is defined in a distal end of the post 12. A positioning means 18 which has an end fixedly connected to the post 12 and a free end which is a hook head 181 communicates with the engaging recess 17. A slot 16 is defined in the post 12 and communicates with the passages 15. A plate 60 is removably inserted into the slot 16 so that the plate 60 separates each passage 15 into two partitions so as to receive two short bits 50 within each passage 15. A long passage 120 is located below the slot 16 receives a long bit 40. In order to securely position the plate 60 in the slot 16, two bosses 81 extend from the plate 60 and firmly engaged with a periphery defining the slot 16. Two projections 13 extend from the post 12 and located on two sides of the slot 16. Two recessed areas 14 are defined in a surface of the post 12 close to the top of the post 12. Two first ridges 19 extends from two ends of the post 12.

Figure 4:
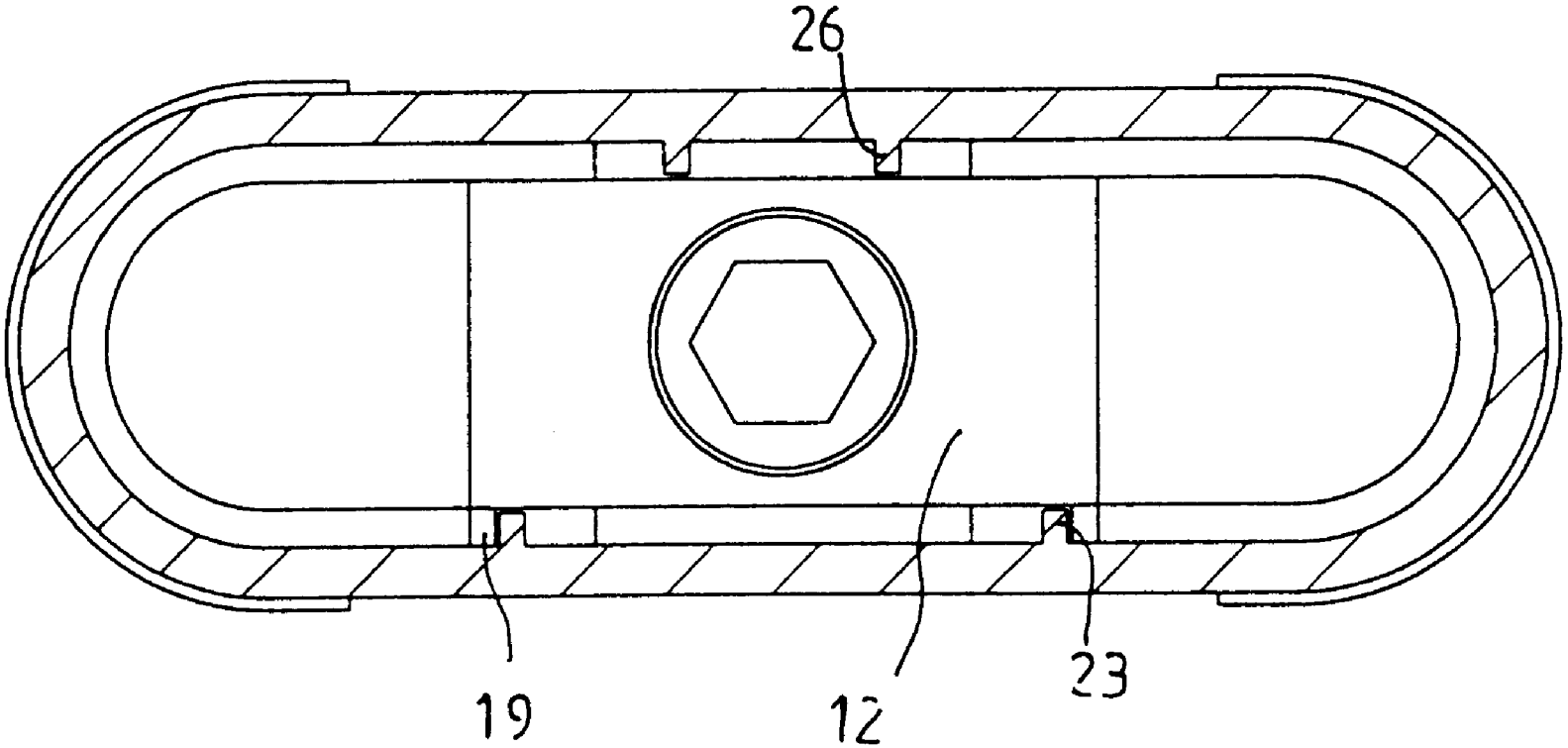
FIG. 4 is a top cross-sectional view to show the ridges on the inside of the cap contact ridges on the post of the tool box.
Figure 5:
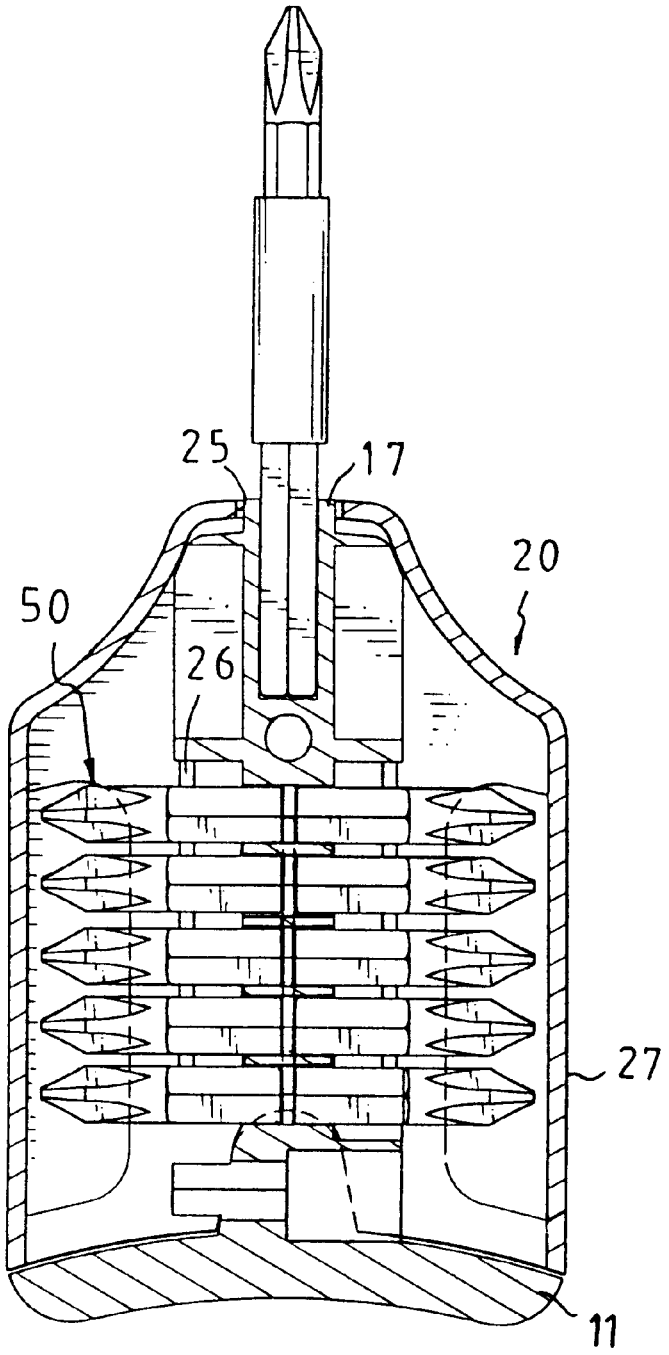
FIG. 5 is a cross sectional view to show that a bit is engaged with an engaging recess in the post and the tool box is used as a screwdriver.
Figure 6:
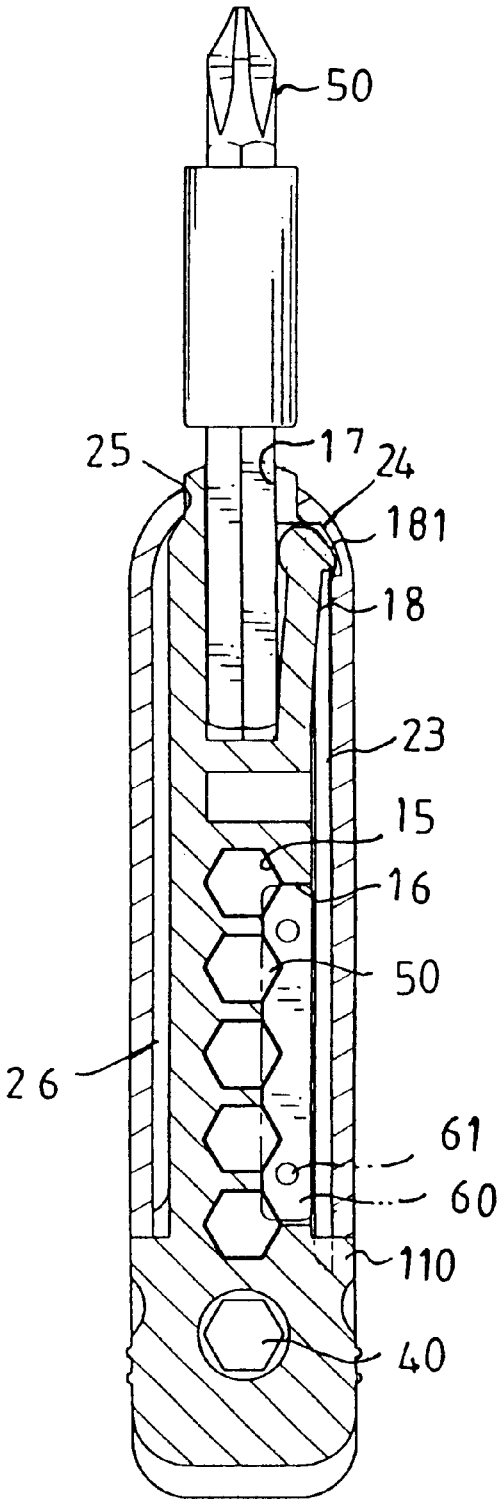
FIG. 6 is a side elevational view, partly in section, of the tool box as shown in FIG. 5.

The cap 20 has an open bottom and a close top, wherein the cap 20 is movably mounted to the body 10 and a hole 25 is defined through the close top of the cap 20. The hole 25 is located in alignment of the engaging recess 17 in the post 10 so that a bit 50 can be extended through the hole 25 and engaged with the engaging recess 17 as shown in FIG. 5 so that the tool box is used as a screwdriver. As shown in FIG. 6, when the bit 50 is inserted into the engaging recess 17, the bit 50 pushes a rounded portion 180 of the hook head 181 to let the hook head 181 be engaged with a notch 24 defined in an inside of the cap 20 so that the cap 20 is positioned when using the tool box. Two second ridges 23 extend from the inside of the cap 20 so that the second ridges 23 are slidable along the first ridges 19 as shown in FIG. 4 when moving the cap 20 relative to the post 12. Two urging ridges 26 extend from the inside of the cap 20 and are located on opposite surface of the cap 20. When the cap 20 is mounted to the post 12, the urging ridges 26 urge the post 12 so as to prevent from shaking of the cap 20.

Two protrusions 110 extend from the board 11 and the post 12 is located between the two protrusions 110. The cap 20 has two cavities 21 defined in two edges of the open bottom so as to let the two protrusions 110 engage with the cavities 21.

The cap 20 has two apertures 22 defined therethrough and a U-shaped plate 30 is connected to the inside of the cap 20 by engaging two distal ends 31 of the U-shaped plate 30 with the two apertures 22. The U-shaped plate 30 has two convexities 32 and two notches are defined in a rear side of the two convexities 32. When the cap 20 is moved downward toward the board 11, the two projections 13 on the post 12 are engaged with the two notches of the U-shaped plate 30 to notify the user the cap 20 is moved to its lowest position. When the cap 20 is moved toward the distal end of the post 12, the two ends of the U-shaped plate 30 are engaged with the recessed areas 14 to prevent the cap 20 from separating from the post 12. The cap 20 includes two transparent side portions 27 so that the user may check the bits 50 via the two transparent side portions 27.

Figure 7:
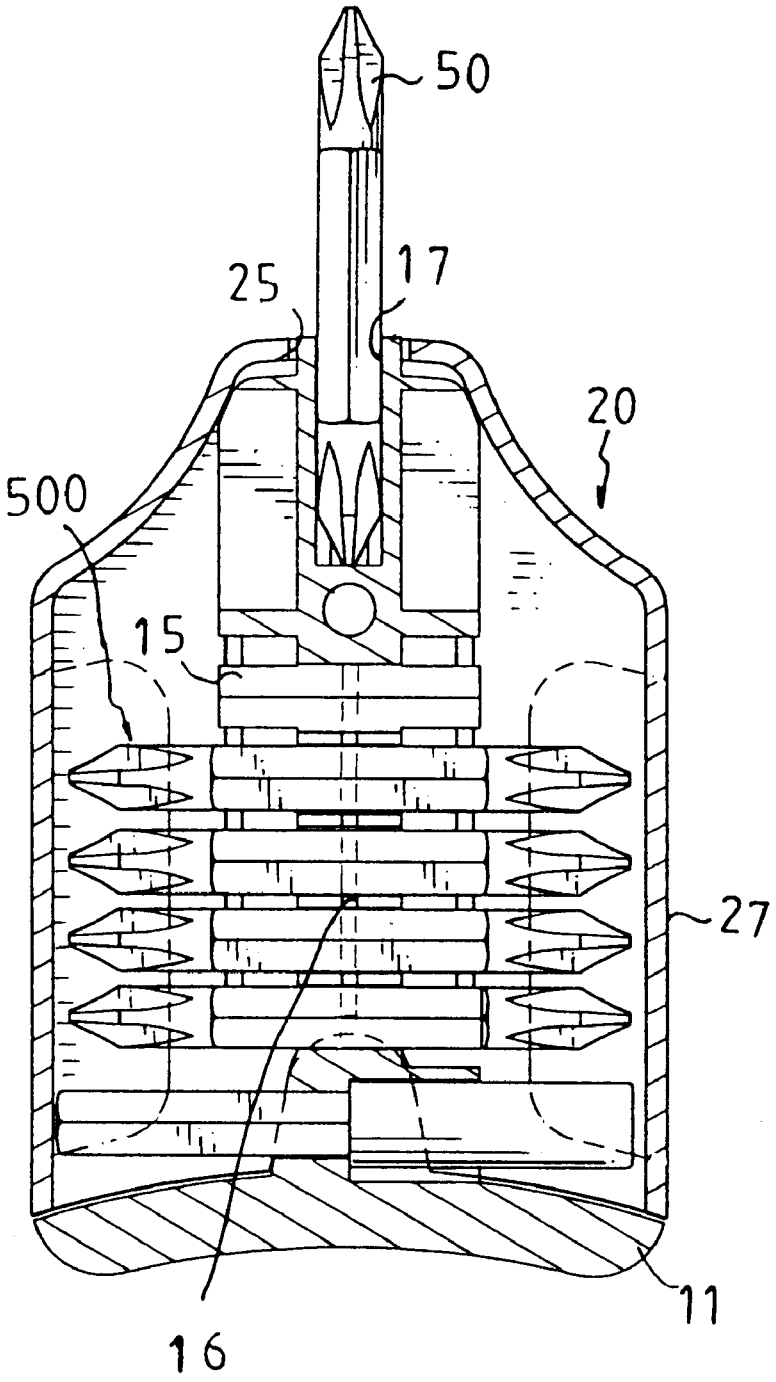
FIG. 7 shows that long bits are received in the passages in the post of the tool box.

FIG. 7 shows that when the plate 60 is removed from the slot 16, long bits 500 can be received in the passages 15.

While we have shown and described various embodiments in accordance with the present invention, it should be clear to those skilled in the art that further embodiments may be made without departing from the scope and spirit of the present invention.

What is claimed is:

1. A tool box comprising:

a body having a board and a post extending from said board, a plurality of passages defined through said post, an engaging recess defined in a distal end of said post, and a cap having an open bottom and a closed top, said cap movably mounted to said body and a hole defined through said closed top of said cap, said hole located in alignment with said engaging recess in said post.

2. The tool box as claimed in claim 1 further comprising a positioning means which has an end fixedly connected to said post and a free end of said positioning means communicates with said engaging recess, said cap having a notch defined in an inside thereof so that said positioning means is removably engaged with said notch.

3. The tool box as claimed in claim 2 wherein said positioning means has a hook head which is removably engaged with said notch.

4. The tool box as claimed in claim 1 further comprising two first ridges extending from said post and two second ridges extending from an inside of said cap, said second ridges slidable along said first ridges.

5. The tool box as claimed in claim 1 further comprising a slot defined in said post and communicating with said passages, a plate removably inserted into said slot.

6. The tool box as claimed in claim 1 wherein said cap has two apertures defined therethrough and a U-shaped plate is connected to an inside of said cap, two distal ends of said U-shaped plate engaged with said two apertures, two recessed areas defined in a surface of said post and two ends of said U-shaped plate engaged with said two recessed areas to prevent said cap from separating from said post.

7. The tool box as claimed in claim 1 further comprising two protrusions extending from said board and said post located between said two protrusions, said cap having two cavities defined in two edges of said open bottom, said two protrusions engaged with said cavities.

* * * * *